US007631867B2

(12) United States Patent
Dejong et al.

(10) Patent No.: US 7,631,867 B2
(45) Date of Patent: Dec. 15, 2009

(54) MOVING CARRIAGE LATERAL REGISTRATION SYSTEM

(75) Inventors: Joannes N M Dejong, Hopewell Junction, NY (US); Lloyd A Williams, Mahopac, NY (US); Barry P Mandel, Fairport, NY (US); Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/191,360

(22) Filed: Aug. 14, 2008

(65) Prior Publication Data

US 2008/0296835 A1 Dec. 4, 2008

Related U.S. Application Data

(62) Division of application No. 11/040,396, filed on Jan. 21, 2005, now Pat. No. 7,422,211.

(51) Int. Cl.
*B65H 7/02* (2006.01)

(52) U.S. Cl. ..... 271/227

(58) Field of Classification Search ..... 271/248, 271/249, 250, 251, 252, 253, 254, 227, 228
See application file for complete search history.

(56) References Cited

U.S. PATENT DOCUMENTS

| | | | | |
|---|---|---|---|---|
| 4,511,242 | A | 4/1985 | Ashbee et al. | |
| 4,919,318 | A | 4/1990 | Wong | |
| 4,936,527 | A | 6/1990 | Gorges | |
| 4,971,304 | A | 11/1990 | Lofthus | |
| 5,078,384 | A | 1/1992 | Moore | |
| 5,094,442 | A | 3/1992 | Kamprath et al. | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,332,892 | A | 7/1994 | Li et al. | 235/462.49 |
| 5,337,133 | A | 8/1994 | Siegel et al. | |
| 5,486,923 | A | 1/1996 | Mitchell et al. | 356/499 |
| 5,646,730 | A | 7/1997 | Mitchell et al. | 356/499 |
| 5,678,159 | A | 10/1997 | Williams et al. | |
| 5,697,608 | A | 12/1997 | Castelli et al. | |
| 5,783,752 | A | 7/1998 | Thorburn et al. | 73/800 |
| 5,794,176 | A | 8/1998 | Milillo | |
| 5,848,344 | A | 12/1998 | Milillo et al. | |
| 6,019,365 | A | 2/2000 | Matsumura | 271/227 |
| 6,059,284 | A | 5/2000 | Wolf et al. | |
| 6,173,952 | B1 | 1/2001 | Richards et al. | |
| 6,533,268 | B2 | 3/2003 | Williams et al. | |
| 6,575,458 | B2 | 6/2003 | Williams et al. | |
| 6,663,103 | B2 | 12/2003 | Dobberstein et al. | 271/227 |
| 6,942,214 | B2 | 9/2005 | Riccardi | 271/227 |
| 7,055,819 | B2 | 6/2006 | Eitel et al. | 271/227 |
| 2004/0188929 | A1 * | 9/2004 | Tada et al. | 271/248 |
| 2005/0074267 | A1 | 4/2005 | Demchock et al. | 399/396 |
| 2006/0097733 | A1 | 5/2006 | Roziere | 324/662 |

* cited by examiner

*Primary Examiner*—Patrick H Mackey
*Assistant Examiner*—Thomas A Morrison

(57) ABSTRACT

A method of registering sheets laterally and in skew enables active sheet deskew without translating the sheet in the cross-process direction. A sensor carriage position is controlled to find the sheet edge after which deskew control can start. The average value of the carriage position can then be fed in a feedforward manner to move the image location to match the average paper position. This achieves good average lateral registration and active skew control at a reduced cost.

2 Claims, 4 Drawing Sheets

MOVING CARRIAGE LATERAL REGISTRATION SYSTEM

This is a divisional of U.S. application Ser. No. 11/040,396 filed Jan. 21, 2005 by the same inventors, now U.S. Pat. No. 7,422,211, and claims priority therefrom. This divisional application is being filed in response to a restriction requirement in that prior application. The heretofore specifically enumerated prior application is hereby incorporated by reference.

Disclosed in the embodiments herein is an improved system for sheet lateral registration and sheet deskewing in the same combination apparatus. Various prior combined automatic sheet lateral registration and deskewing systems are known in the art. The below-cited patent disclosures are noted by way of some examples. They demonstrate the long-standing efforts in this technology for more effective yet lower cost sheet lateral registration and deskewing, particularly for printers (including, but not limited to, xerographic copiers and printers). They demonstrate that it has been known for some time to be desirable to have a sheet deskewing system that can be combined with a lateral sheet registration system, in a sheet driving system also maintaining the sheet forward speed and registration (for full three axis sheet position control) in the same apparatus. That is, it is desirable for both the sheet deskewing and lateral registration to be done while the sheets are kept moving along a paper path at a defined substantially constant speed. Otherwise known as sheet registration "on the fly" without sheet stoppages. Yet these prior systems have had some difficulties, which the novel systems disclosed herein address, further discussed below. In particular, high cost, especially for faster sheet feeding rates. However, it will be noted that the combined sheet handling systems disclosed herein are not limited to only high speed printing applications.

For faster printing rates, requiring faster sheet feeding rates along paper paths, which can reach more than, for example, 100-200 pages per minute, the above combined systems and functions become much more difficult and expensive. Especially, to accomplish the desired sheet skew rotation, sheet lateral movement, and forward sheet speed during the brief time period in which each sheet is in the sheet driving nips of the combined system. As further discussed below, such high speed sheet feeding for printing or other position-critical applications heretofore has commonly required, for the lateral sheet registration, variable rapid acceleration lateral (sideways to the sheet path) movements of relatively high mass system components, and substantial power for that rapid acceleration and rapid movement. Or, rapid "wiggling" of the sheet by deskewing, deliberately skewing, and again deskewing the sheet for side registration, all during that same brief time period the sheet is held in the sheet feeding nips of the system. Furthermore, in either such prior system, two high power servo-motors and their controls have typically been required for independently driving a laterally spaced pair of separate sheet driving nips, adding both expense and mass to the system.

Disclosed in the embodiments herein is an improved system for controlling, correcting or changing the orientation and position of sheets traveling in a sheet transport path. In particular, but not limited thereto, sheets being printed in a reproduction apparatus, which may include sheets being fed to be printed, sheets being recirculated for second side (duplex) printing, and/or sheets being outputted to a stacker, finisher or other output or module.

Disclosed in the embodiments herein is an improved system for deskewing and also transversely repositioning sheets with a lower cost, lower mass mechanism, and which for sheet feeding and deskewing needs only one single main drive motor for the two sheet feed roll drives, together with a much lower power, and lower cost, deskewing differential drive. This is in contrast to various of the below-cited and other systems which require three separate, large, high power, and separately controlled, servo or stepper motor drives. Yet the disclosed embodiments can provide in the same unit active automatic variable sheet deskewing and active variable side shifting for lateral registration, both while the sheet is moving uninterruptedly at process speed. It is applicable to various reproduction systems herein generally referred to as printers, including high-speed printers, and other sheet feeding applications. In particular the system of the disclosed embodiments can provide greatly reduced total moving mass, and therefor provide improvements in integral lateral registration systems involving rapid lateral movement thereof, such as the TELER type of lateral registration system described below.

Various types of lateral registration and deskew systems are known in the art. A recent example is Xerox Corp. U.S. Pat. No. 6,173,952 B1, issued Jan. 16, 2001 to Paul N. Richards, et al (and art cited therein). That patent's disclosed additional feature of variable lateral sheet feeding nip spacing, for better control over variable size sheets, may be readily combined with or into various applications of the present invention, if desired.

As noted, it is particularly desirable to be able to do lateral registration and deskew "on the fly," while the sheet is moving through or out of the reproduction system at normal process (sheet transport) speed. Also, to be able to do so with a system that does not substantially increase the overall sheet path length, or increase paper jam tendencies. The following additional patent disclosures, and other patents cited therein, are noted by way of some examples of sheet lateral registration systems with various means for side-shifting or laterally repositioning the sheet: Xerox Corporation U.S. Pat. No. 5,794,176, issued Aug. 11, 1998 to W. Milillo; U.S. Pat. No. 5,678,159, issued Oct. 14, 1997 to Lloyd A. Williams, et al; U.S. Pat. No. 4,971,304, issued Nov. 20, 1990 to Lofthus; U.S. Pat. No. 5,156,391, issued Oct. 20, 1992 to G. Roller; U.S. Pat. No. 5,078,384, issued Jan. 7, 1992 to S. Moore; U.S. Pat. No. 5,094,442, issued Mar. 10, 1992 to D. Kamprath, et al; U.S. Pat. No. 5,219,159, issued Jun. 15, 1993 to M. Malachowski, et al; U.S. Pat. No. 5,169,140, issued Dec. 8, 1992 to S. Wenthe; and U.S. Pat. No. 5,697,608, issued Dec. 16, 1997 to V. Castelli, et al. Also, IBM U.S. Pat. No. 4,511,242, issued Apr. 16, 1985 to Ashbee, et al.

Various optical sheet lead edge and sheet side edge position detector sensors are known which may be utilized in such automatic sheet deskew and lateral registration systems. Various of these are disclosed in the above-cited references and other references cited therein, or otherwise, such as the above-cited U.S. Pat. No. 5,678,159, issued Oct. 14, 1997 to Lloyd A. Williams, et al; and U.S. Pat. No. 5,697,608 to V. Castelli, et al.

Various of the above-cited and other patents show that it is well known to provide integral sheet deskewing and lateral registration systems in which a sheet is deskewed while moving through two laterally spaced apart sheet feed roller-idler nips, where the two separate sheet feed rollers are independently driven by two different respective drive motors. Temporarily driving the two motors at slightly different rotational speeds provides a slight difference in the total rotation or relative pitch position of each feed roller while the sheet is held in the two nips. That moves one side of the sheet ahead of the other to induce a skew (small partial rotation) in the sheet opposite from an initially detected sheet skew in the sheet as the sheet enters the deskewing system. Thereby deskewing the sheet so that the sheet is now oriented with (in line with) the paper path.

However, especially for high speed printing, sufficiently accurate continued process (downstream) sheet feeding requirements typically requires these two separate drive motors to be two relatively powerful and expensive servo-motors. Furthermore, although the two drive rollers are desirably axially aligned with one another to rotate in parallel planes and not induce sheet buckling or tearing by driving forward at different angles, the two drive rollers cannot both be fixed on the same common transverse drive shaft, since they must be independently driven.

For printing in general, the providing of both sheet skewing rotation and sheet side shifting while the sheet is being fed forward in the printer sheet path is a technical challenge, especially as the sheet path feeding speed increases. Print sheets are typically flimsy paper or plastic imageable substrates of varying thinnesses, stiffnesses, frictions, surface coatings, sizes, masses and humidity conditions. Various of such print sheets are particularly susceptible to feeder slippage, wrinkling, or tearing when subject to excessive accelerations, decelerations, drag forces, path bending, etc.

The above-cited Xerox Corp. U.S. Pat. No. 4,971,304, issued Nov. 20, 1990 to Lofthus (and various subsequent patents citing that patent, including the above-cited Xerox Corp. U.S. Pat. No. 6,173,952 B1, issued Jan. 16, 2001 to Paul N. Richards, et al) are of interest as showing that a two nips differentially driven sheet deskewing system, as described above, can also provide sheet lateral registration in the same unit and system, by differentially driving the two nips to provide full three axis sheet registration with the same two drive rollers and two drive motors, plus appropriate sensors and software. That type of deskewing system can provide sheet lateral registration by deskewing (differentially driving the two nips to remove any sensed initial sheet skew) and then deliberately inducing a fixed amount of sheet skew (rotation) with further differential driving, and driving the sheet forward while so skewed, thereby feeding the sheet sideways as well as forwardly, and then removing that induced skew after providing the desired amount of sheet side-shift providing the desired lateral registration position of the sheet edge. This Lofthus-type system of integral lateral registration does not require rapid side-shifting of the mass of the sheet feed nips and their drives, etc., for lateral registration. However, as noted, this Lofthus-type of lateral registration requires rapid plural rotations (high speed "wiggling") of the sheet. That has other challenges with increases in the speed of the sheet being both deskewed and side registered by plural differential rotations of the two nips, requiring additional controlled differential roll pair driving, especially for large or heavy sheets, and requires two separate large servo-motors for the two nips.

In contrast to the above-described Lofthus '304 type system of sheet lateral registration are sheet side-shifting systems in which the entire structure and mass of the carriage containing the two drive rollers, their opposing nip idlers, and the drive motors (unless splined drive telescopically connected), is axially side-shifted to side-shift the engaged sheet into lateral registration. In the latter systems the sheet lateral registration movement can be done during the same time as, but independently of, the sheet deskewing movement, thereby reducing the above-described sheet rotation requirements. These may be broadly referred to as "TELER" systems, of, e.g., U.S. Pat. No. 5,094,442, issued Mar. 10, 1992 to Kamprath et al; U.S. Pat. No. 5,794,176 and 5,848,344 to Milillo, et al; U.S. Pat. No. 5,219,159, issued Jun. 15, 1993 to Malachowski and Kluger (citing numerous other patents); U.S. Pat. No. 5,337,133; and other above-cited patents.

For high speed sheet feeding, however, the rapid lateral acceleration and deceleration of a large mass in such prior TELER systems requires yet another (third) large drive motor to accomplish in the brief time period in which the sheet is still held in (but passing rapidly through) the pair of drive nips. That is, the entire deskew mechanism of two independently driven transversely spaced feed roll nips must move laterally by a variable distance each time an incoming sheet is optically detected as needing lateral registration, by the amount of side-shift needed to bring that sheet into lateral registration. Also, an even more rapid opposite transverse return movement of the same large mass may be required in a prior TELER system to return the system back to its "home" or centered position before the (closely following) next sheet enters the two drive nips of the system. Especially if each sheet is entering the system laterally miss-registered in the same direction, as can easily occur, for example, if the input sheet stack side guides are not in accurate lateral alignment with the machines intended alignment path, which is typically determined by the image position of the image to be subsequently transferred to the sheets. Thus prior TELER type systems required a fairly costly operating mechanism and drive system for integrating lateral registration into a deskew system.

To express this issue in other words, existing paper registration devices desirably register the paper in three degrees of freedom, i.e., process, lateral and skew. To do so in a single system or device, three independently controlled actuators are used in previous TELER type implementations in which the skew and process actuators are mounted on a carriage that is rapidly actuated laterally, requiring a relatively large additional motor. That is, the addition of lateral actuation requires the use of a laterally repositioning driven carriage, or a more complex coupling between lateral and skew systems must be provided. On the other hand, a Lofthus patent type system (as previously described) may require extra "wiggling" of the sheet by the drive nips to add and remove the induced skew, and that extra differential sheet driving (driving speed changes) can have increased drive slip potential.

In any of these systems, or the "SNIPS" system noted below, the use of sheet position sensors, such as a CCD multi-element linear strip array sensor, could be used in a feedback loop for slip compensation to insure the sheet achieving the desired three-axis registration. See, e.g., the above-cited U.S. Pat. No. 5,678,159 to Lloyd A. Williams, et al.

Other art of lesser background interest on both deskewing and side registration, using a pivoting sheet feed nip, includes Xerox Corp. U.S. Pat. Nos. 4,919,318 and 4,936,527 issued to Lam Wong. However, as with some other art cited above, these Wong systems use fixed lateral sheet edge guides against which aside edges of all the sheets must rub as they move in the process direction, with potential wear problems. Also, they provide edge registration and cannot readily provide center registration in a sheet path of different size sheets.

Particularly noted as to a pivoting nips deskew and side registration system without such fixed edge guides, which can provide center registration, is the "SNIPS" system of both pivoting and rotating plural sheet feeding balls (with dual, different axis, drives per ball) of Xerox Corp. U.S. Pat. No. 6,059,284, issued May 9, 2000 to Barry M. Wolf, et al. However, the embodiments disclosed herein do not require such pivoting (dual axis) sheet engaging nips. I.e., they do not require pivoting or rotation of sheet drive rollers or balls about an additional axis or rotation orthogonal to the normal concentric drive axis of rotation of the sheet drive rollers. Also, the disclosed embodiments allow the use of normal low slippage high friction feed rollers which may provide normal roller-width sheet line engagement of the sheet in the sheet feeding nips with an opposing idler roller, rather than ball drives with point contacts as in said U.S. Pat. No. 6,059,284.

As noted above, and as further described for example in the above-cited and other art, existing modern high speed xerographic printer paper registration devices typically use two spaced apart sheet drive nips to move the paper in the process direction, with the velocities of the two nips being independently driven and controlled by each having its own relatively expensive servo drive motor. Paper skew may thus be corrected by prescribing different velocities (V1, V2) for the two nips (nip 1 and nip 2) with the two servo-motors for a defined short period of time while the sheet is in the two nips. Typically, rotary encoders measure the driven angular velocity of both nips and a motor controller or controllers keeps this velocity at a prescribed target value V1 for nip 1 and V2 for nip 2. That velocity may be maintained the same until, and during, skew correction. The skew of the incoming paper is typically detected and determined from the difference in the time of arrival of the sheet lead edge at two laterally spaced sensors upstream of the two drive nips, multiplied by the known incoming sheet velocity. That measured paper skew may then be corrected by prescribing, with the motor controller(s), slightly different velocities (V1, V2) for the two nips for a short period of time while the sheet is in the nips. Although the power required for that small angular speed differential V1, V2 change (a slight acceleration and/or deceleration) for skew correction is small, both servo-motors must have sufficient power to continue to propel the paper in the forward direction at the proper process speed. That is, for this deskewing action, nip 1 and nip 2 are driven at different rotational velocities. However, the average forward velocity of the driven sheet of paper is 0.5 (V1+V2) and that forward velocity is desirably maintained substantially at the normal machine process (paper path) velocity. Two degrees of freedom (skew and forward velocity) are thus controlled with two independent and relatively large servo-motors driving the two spaced nips at different speeds in these prior systems.

Although the drive systems illustrated in the examples herein are shown in a direct drive configuration, that is not required. For example, a timing belt or gear drive with a 4:1 or 3:1 ratio could be alternatively used.

As noted above, providing the remaining lateral or third degree of sheet movement freedom and registration in present systems which desirably combine deskew and lateral registration typically require control by a third large servo-motor, as in the TELER type lateral registration systems described above, and relatively complex coupling mechanisms, for a further cost increase.

In any case, even in the above-described deskewing systems per se, since the two sheet driving and deskewing nips are completely independently driven, both drive motors therefor must have sufficient power and variable speed control to accurately propel the paper in the forward (process or downstream) sheet feeding direction at the desired process speed.

In Xerox Corporation U.S. Pat. Nos. 6,533,268 B2 and 6,575,458 B2, both issued to Lloyd A. Williams et al., a sheet deskewing system is disclosed that can be used to implement the present disclosure and needs only one (not two) such forward drive motor, for both nips, with sufficient power to propel the paper in the forward direction, and a second smaller and cheaper motor and differential system. That is, showing how to use only one drive to propel the paper in the forward direction and a second and much smaller and cheaper skew correction drive to correct for skew through a differential mechanism adjusting the rotational phase between the two nips without imposing any of the sheet driving load on that skew correction drive. This can provide significant cost savings, as well as, reduced mass and other improvements in lateral sheet registration.

A specific feature of the specific embodiments disclosed herein is to provide a combined sheet registration system that includes a lateral sheet registration system combined with a sheet deskewing and sheet forward feeding system that uses a closed loop feedback method that continuously adjusts the lateral and skew position of a sheet.

A further specific feature disclosed in the embodiments herein, individually or in combination, include those wherein active deskew of media is obtained without translating the sheet in the cross-process direction. Yet another specific feature disclosed in the embodiments herein include a method of using lateral the lateral and skew registration actuators to provide the alignment function just before the registration function is completed.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present disclosure will be better understood from this description of these specific embodiments, including the drawing figures (which are approximately to scale) wherein:

Figure 1:
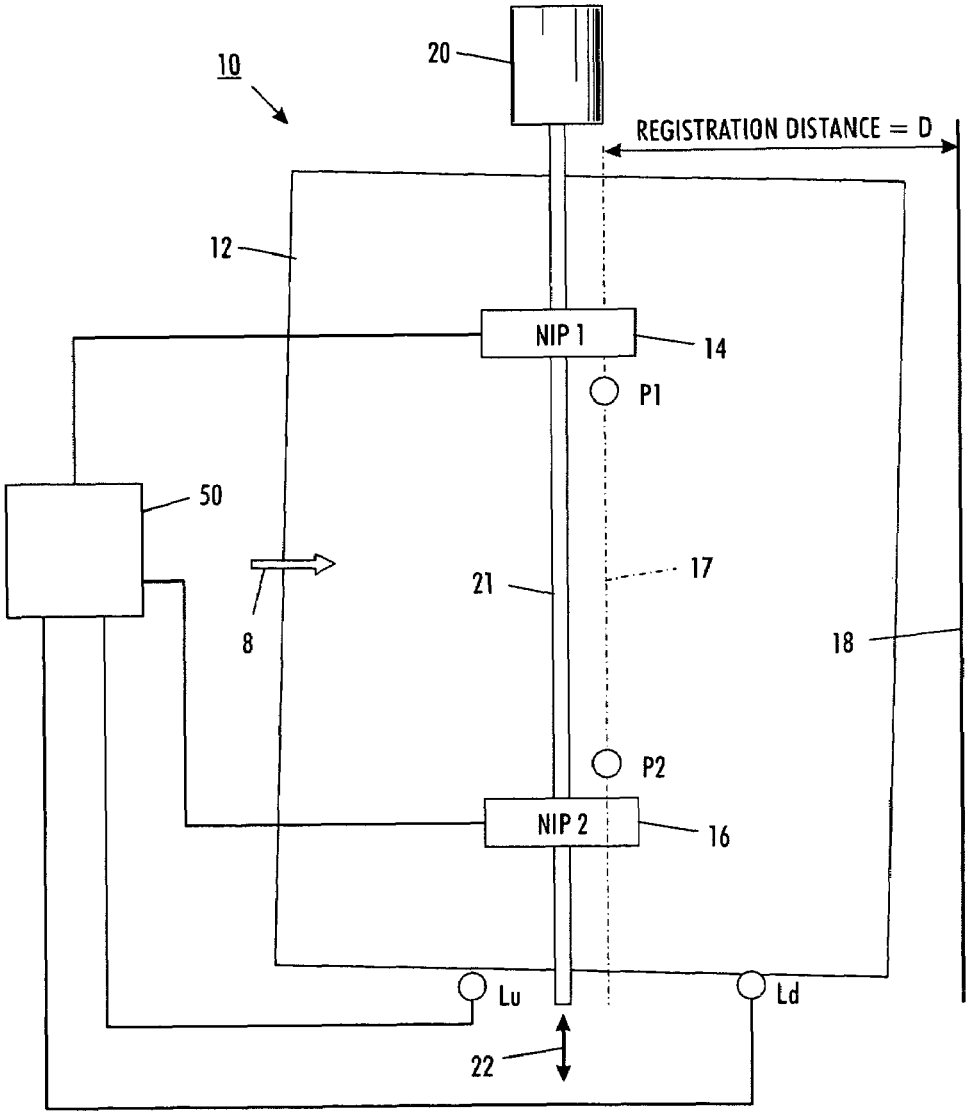
FIG. 1 is a partially schematic plan view, of an exemplary printer paper path, of one embodiment of a dual nip deskewing and lateral registration system.

Describing now in further detail these exemplary embodiments with reference to the Figures, as described above these sheet deskewing systems are typically installed in a selected location or locations of the paper path or paths of various conventional printing machines, for deskewing a sequence of sheets 12, as discussed above and as taught by the above and other references. Hence, only a portion of an exemplary printer paper path need be illustrated here. In FIG. 1, a registration station 10 for aligning sheets 12 for further downstream processing is shown. Such stations are used to control the feed of the copy sheet along the feed path and position (register) the lead edge of the copy sheet so that it is fed in proper synchronization to a downstream work station. Such stations also align (register) the side edge of the copy sheet so that it is properly registered in the transverse direction for a downstream work station. In addition, the station controls the angular orientation (skew) of the sheet as it is fed to downstream operations.

Examples of electronic copy sheet registration systems in which the present disclosure can be used are shown in U.S. Pat. Nos. 6,575,458 B2 and 6,533,268 B2, the disclosures of which are incorporated herein by reference.

In the embodiment of FIG. 1, two drive rolls 14 and 16 form nips with idler rolls (not shown). The term "nips" is used herein to refer to the contact point between one upper roller and one lower roller in each of the nip roller pairs in the apparatus of FIGS. 1 and 4. The drive rolls and idler rolls are rotatably mounted and are positioned to drive copy sheet 12 in the direction of arrow 8 through the registration station 10. Registration of sheet 12 is accomplished within a registration distance D between dashed line 17 and sheet handoff place 18. A conventional process direction motor 20 imposes an average velocity on NIP 1 and NIP 2 and propels the sheet in the process direction. En route to sheet handoff place 18, sheet 12 encounters sensors Lu and Ld that are used to measure the lateral and skew position of the sheet. These measurements are fed back to controller 50 that manipulates conventional lateral actuator 64 shown in FIG. 2 and skew actuator 76 shown in FIG. 3 through, respective, lateral controller 62 and skew controller 74. Sensor Lu is used for lateral feedback control and the difference in the reported position of Lu and Ld is used for skew feedback control. Sensors Lu and Ld can be point sensors and may be located in a predetermined position based upon sheet size or desired media position. For higher accuracy, sensors with a limited analog range (e.g. +/−0.5 mm) is preferable. Linearity of the sensors is not important and the sensors can have an analog range that is much smaller than the required corrections. The sensors simply saturate, but are still able to tell a controller in which direction to move a sheet. Sensors P1 and P2 detect the arrival of sheet 12 in the nips and start the lateral and skew registration.

Figure 2:
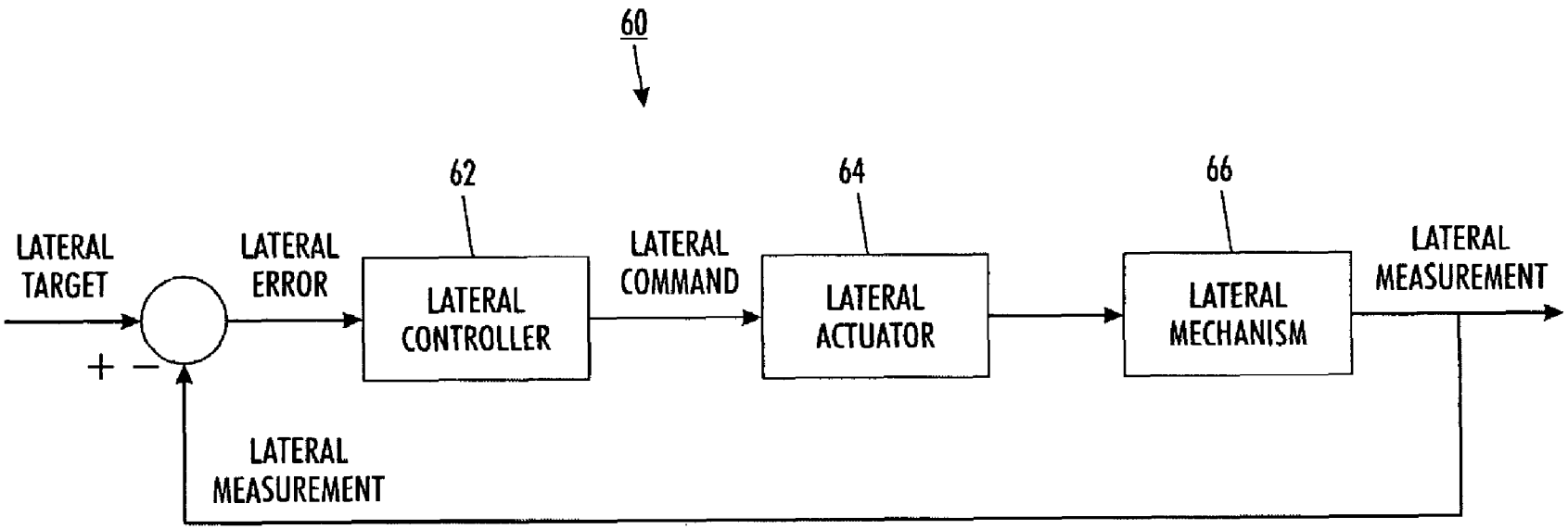
FIG. 2 is a schematic block diagram of a lateral control scheme used in the FIG. 1 deskewing and lateral registration system.

Once sheet 12 arrives in nips NIP 1 and NIP 2, a lateral control algorithm commences as shown in the lateral control block 60 of FIG. 2. The center (Null) of sensor Lu is the target position for the lateral control loop. It represents a lateral registration error of zero. The measurement of sheet edge position as sensed by the Lu sensor is subtracted from the lateral target at controller 50. This lateral error is responded to with a signal from computer 50 to lateral controller 62 which in turn sends a lateral command to lateral actuator 64 which moves lateral mechanism 66 movably connected to shaft 21 to change the position of NIP 1 and NIP 2. This action continues until the lead edge of the sheet reaches the handoff point.

Figure 3:
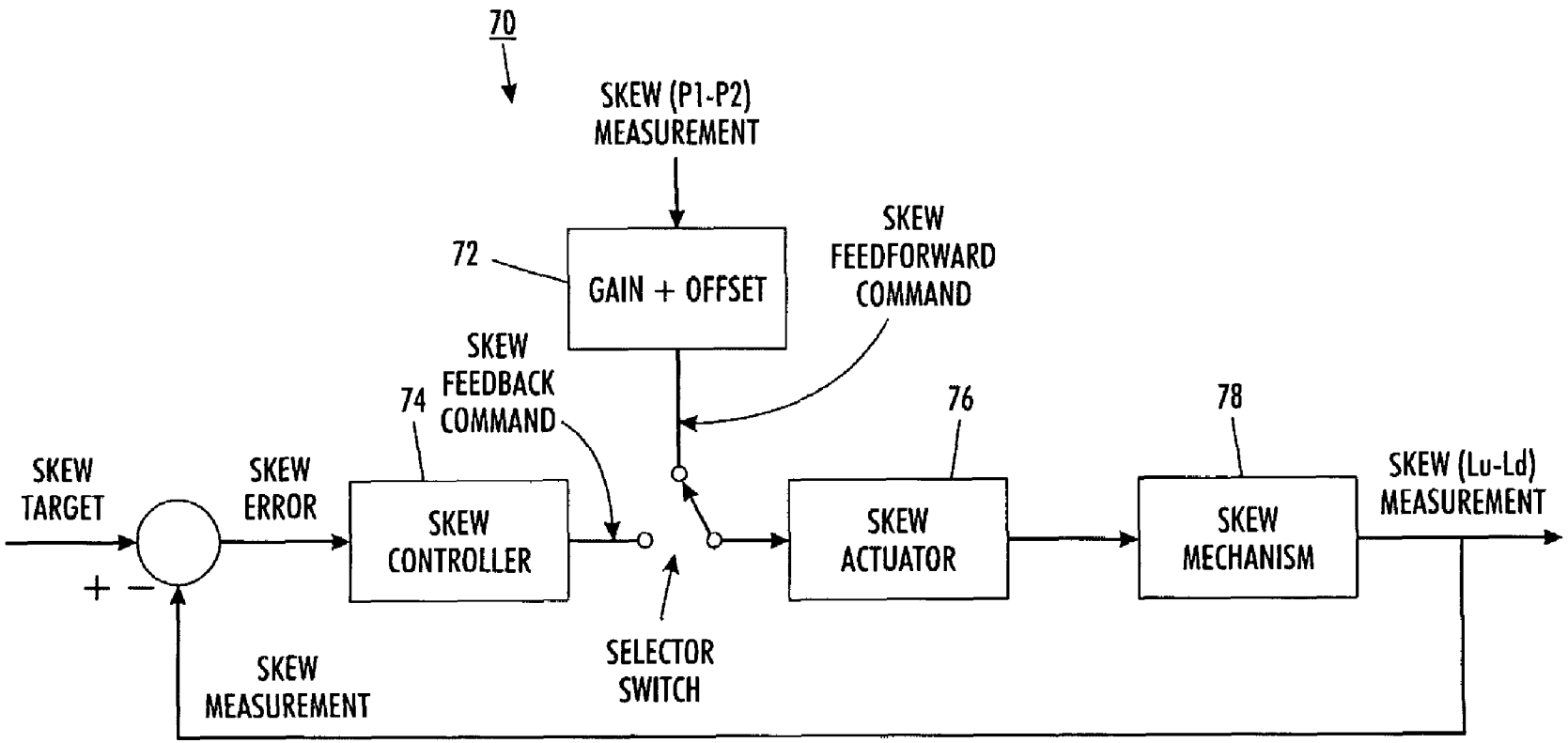
FIG. 3 is a schematic block diagram of a skew registration control scheme used in the FIG. 1 deskewing and lateral registration system.

The skew control algorithm of the skew control block 70 in FIG. 3 commences upon the arrival of sheet 12 in nips NIP 1 and NIP 2. The skew sheet control consist of two sequential parts, i.e., feedforward skew control (switch as shown in FIG. 3) and feedback skew control (switch in the opposite position). In addition, a learning algorithm is used to learn the value of the "Offset" in the skew feedforward control. Feedforward skew control starts as soon as sheet 12 is detected by sensors P1 and P2. The difference in time of arrival of the sheet at P1 and P2 multiplied by the process direction speed and divided by P1 and P2 spacing measures the skew of incoming sheet 12. After the skew measurement is made, a signal is sent to skew actuator 76 that in turn signals conventional skew mechanism 78 to deskew the sheet accordingly. Skew actuator 76 is a differential mechanism, which through skew mechanism 78 imposes a difference in axial angle of NIP 1 and NIP 2. The differential actuator Feedforward skew control stops whenever the feedforward command has finished or when feedback control starts.

The command to skew actuator 76 is computed as command=(input Skew−Offset). If the actuator is a stepper motor, the command simply is the number of steps. The "Gain" is a conversion factor relating the number of steps to the input skew measurement. It can be calculated from the geometry of the skew actuator mechanism (gear, helix, etc.). The "Offset" accounts for the non-perpendicularity of the P1/P2 sensors and Lu/Ld sensors and/or non-perpendicularity of the lead-edge/trailedge of sheet 12. This "Offset" can be learned. After the feedforward control is completed, the total number of steps that the feedback controller 74 commanded before handoff of sheet 12 takes place is the amount by which the feedforward controller was in error. A fraction is used to reduce the effect of noise.

Once the lead edge position of sheet 12 reaches sensor Ld, valid skew measurements are obtained. This starts the feedback control. The measurement value is the difference in reported edge position (Lu−Ld) divided by the sensor spacing. A difference value of zero is the target for the lateral skew loop. It represents a skew registration error of zero. The measurement of skew angle as reported by the Lu−Ld is subtracted from the skew target. This skew error is acted upon by skew controller 74 which in turn feeds a command to skew actuator 76 which moves a conventional differential to change the angle of sheet 12. Skew actuator 76 moves the sheet in skew by imposing a difference in axial angle of NIP 1 and NIP 2. This action continues until the lead edge of sheet 12 reaches handoff point 18. It should be understood that the analog range of the Lu/Ld sensors allow set up of the skew by changing the set point of skew controller 74 to a value other than the null of the sensors. This is a fine "software adjustment" and, as such, does not require any hardware tweaking. This can be done for lateral, but the registration specifications for lateral are much less critical.

These deskewing system embodiments provide paper deskewing by differential nip action through a simple and low cost differential mechanism system as disclosed in U.S. Pat. No. 6,575,458 B2 that is incorporated herein by reference to the extent necessary to practice this disclosure. For example, a conventional deskewing system can include a differential system that comprises a pin-riding helically slotted sleeve connector that is laterally transposed by a small low cost differential motor. This particular example includes a tubular sleeve connector having two slots; at least one of which is angular, partially annular or helical. These slots respectively slideably contain the respective projecting pins of the ends of the respective split co-axial drive shafts over which the tubular sleeve connector is slideably mounted. Each drive roller of sheet driving nips is mounted to, for rotation with, a respective one of the drive shafts with one of those drive shafts being driven by a motor through a gear drive, although it could be directly. This type of variable pitch differential connection mechanism is small, accurate, inexpensive, and requires little power to operate. It may be actuated by any of numerous possible simple actuator mechanisms that provide a short linear movement.

Figure 4:
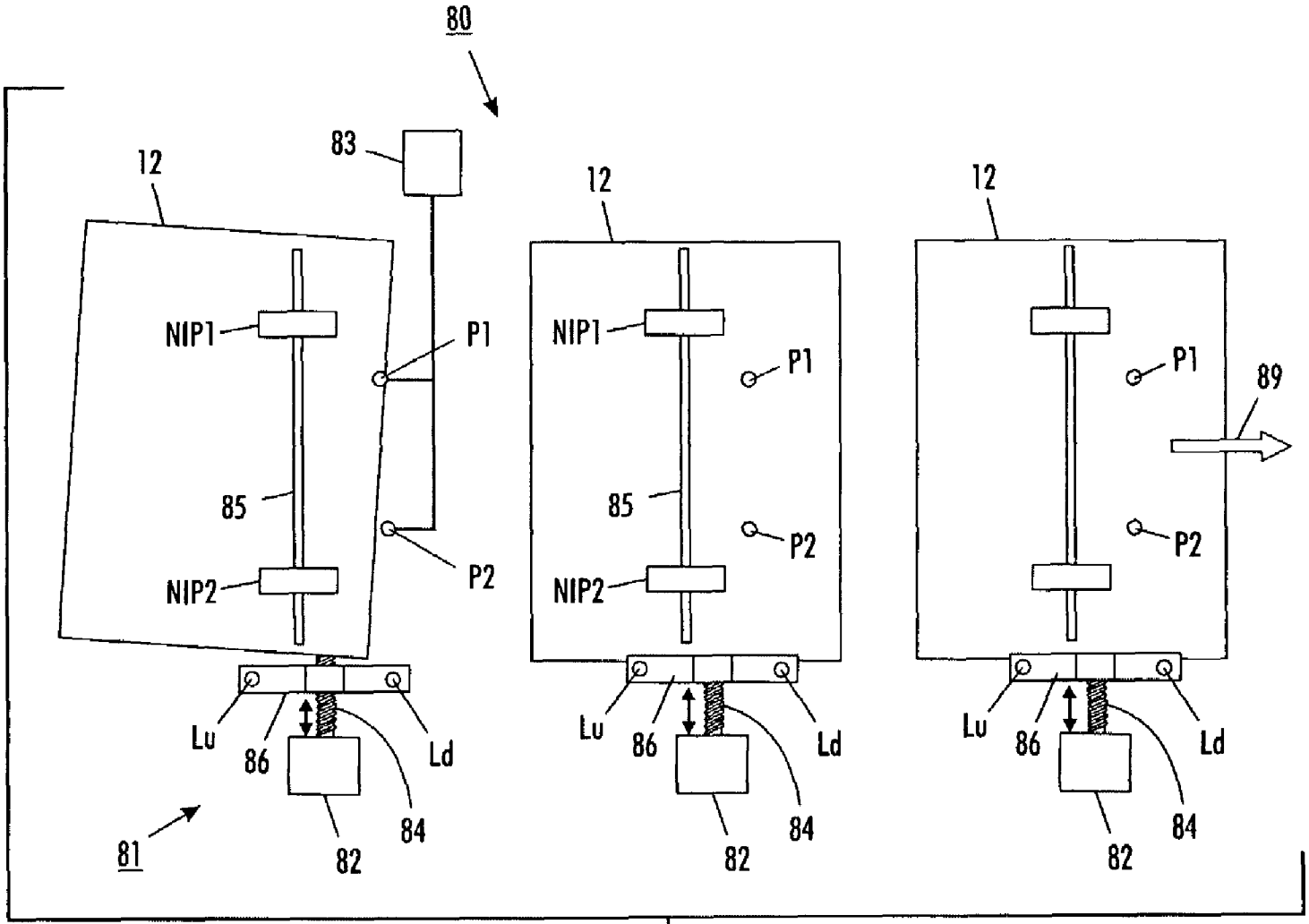
FIG. 4 is a plan view schematically illustrating another lateral and skew control apparatus with a moving sensor carriage.

An alternative embodiment of present disclosure in FIG. 4 shows a moving carriage lateral registration system 80 that enables active deskew of a sheet without translating the sheet in the cross-process direction. Registration takes place in three primary phases as shown from left to right in FIG. 4. System 80 includes nips NIP 1 and NIP 2 that drive sheet 12 in the process direction of arrow 89. Sensors P1 and P2 detect the arrival of sheet 12 in the nips and start the lateral and skew registration. The amount of skew is detected by the difference in time at which the leading edge of the sheet passes each of the sensors. That time difference represents a distance that directly relates to the amount of angular skew of the sheet. The outputs of sensors P1 and P2 are supplied to controller 83 that evaluates the amount of skew and provides an appropriate control signal to a conventional stepping motor (not shown) that in turn provides appropriate directional information such that the angular position of NIP 1 to NIP 2 about axis of rotation 85 is precisely changed to change the angular position of the sheet. The angular adjustment of NIP 1 with respect to NIP 2 takes place while the nips continue to drive the sheet, at high speed, towards a handoff point. A conventional differential drive mechanism useful in practicing this disclosure is shown in U.S. Pat. No. 5,278,624 and is incorporated herein by reference.

Simultaneously, a pair of sensors Lu and Ld mounted on a bar 86 that is connected to a rotatable screw 84 are moved (either inboard or outboard depending on the sheet position, as indicated by the double headed arrow) to "find" the top edge of the sheet. Sensors Lu and Ld send signals to controller 83 that, in turn, actuates motor 82 which through screw mechanism 84 moves bar 86 and the sensors to find the top edge of the sheet. Translating carriage 81 is controlled to follow the sheet to maintain the sensor position relative to the top edge of the sheet while the sheet is actively deskewed. The move distance of sensor carriage 81 and upstream sensor Lu can be used as a feedback sensor to the translating carriage controller 83 as disclosed with reference to FIG. 3 heretofore. The move distance of the sensor carriage is recorded and used to infer the position of each sheet in the cross-process direction. This information can then be used to shift the position of an image of an imaging system to match the sheets (on an average or sheet-by-sheet basis, depending on the imaging system requirements). If the top edge sensors have a known or calibrated range, a specific amount of DC skew correction can be made simply by re-defining the "zero" point of each sensor (which would change the value of Lu−Ld for a given sheet position). This would enable a manufacturing or field set-up of image-to-paper skew without adjusting the mechanical hardware.

In recapitulation, a closed loop feedback method and apparatus is disclosed that continuously adjusts the lateral and skew position of sheets in process within a printing apparatus. A first sensor is used to measure lateral sheet edge position. A second sensor measures the lateral sheet edge position at a predetermined distance from the first sensor. Sheet skew values are calculated based on signals from the sensors. Lateral and skew controllers provide outputs to lateral and skew actuators, respectively, to adjust the sheet position. In another embodiment, active deskew of sheets is enabled without translating the sheet in the cross-process direction. The sensor carriage position is controlled to find the sheet edge after which deskew control is started. The average value of the carriage position can then be fed in a feedforward manner to an imaging processor to move the image location to match the average paper position. Thus, lateral registration and active skew control at a reduced cost is obtained.

It will be appreciated by those skilled in this art that various of the above-disclosed and other versions of the subject improved sheet deskewing system may be desirably combined into many other different lateral registration systems to provide various other improved integral sheet deskew and lateral registration systems.

While the embodiments disclosed herein are preferred, it will be appreciated from this teaching that various alternatives, modifications, variations or improvements therein may be made by those skilled in the art, which are intended to be encompassed by the following claims.

What is claimed is:

1. A closed loop registration method for controlling the skew and lateral position of a sheet that includes a lead edge en route within a predetermined sheet path, comprising:

providing a drive system for driving the sheet in a process direction within said predetermined sheet path and controlling sheet skew;

providing movable first and second sensors positioned along one side of said predetermined sheet path;

moving said first and second sensors laterally with respect to said predetermined sheet path;

controlling said lateral moving of said first and second sensors based on a signal from at least one of said first and second sensors;

determining an amount of sheet skew based on signals from both of said first and second sensors;

controlling the skew of the sheet based on said determined amount of skew;

providing third and fourth sensors;

using said third and fourth sensors to provide a detection signal indicative of said lead edge of the sheet; and using said detection signal of said third and fourth sensors to perform an open loop skew correction before starting said closed loop skew control.

2. A closed loop registration method for controlling the skew and lateral position of a sheet en route within a predetermined sheet path, comprising:

providing a drive system for driving the sheet in a process direction within said predetermined sheet path and controlling sheet skew;

providing movable first and second sensors positioned along one side of said predetermined sheet path;

moving said first and second sensors laterally with respect to said predetermined sheet path;

controlling said lateral moving of said first and second sensors based on a signal from at least one of said first and second sensors;

determining an amount of sheet skew based on signals from both of said first and second sensors;

controlling the skew of the sheet based on said determined amount of skew; recording said moving of said first and second sensors laterally with respect to said predetermined sheet path;

using said recorded lateral moving of said first and second sensors to infer each sheet location; and using said inference to shift position of an image in an imaging system to match each sheet en route within said predetermined sheet path.

* * * * *